US006543661B1

(12) United States Patent
Lazur

(10) Patent No.: US 6,543,661 B1
(45) Date of Patent: Apr. 8, 2003

(54) SHOULDER HARNESS APPARATUS

(76) Inventor: Thomas Lazur, 117 Locust Rd., Coal Center, PA (US) 15423

( * ) Notice: Subject to any disclaimer, the term of this patent is extended or adjusted under 35 U.S.C. 154(b) by 0 days.

(21) Appl. No.: 09/931,809

(22) Filed: Aug. 17, 2001

(51) Int. Cl.[7] ..... A45L 13/30
(52) U.S. Cl. ..... 224/604; 224/605; 224/647
(58) Field of Search ..... 224/647, 602, 224/603, 604, 605

(56) References Cited

U.S. PATENT DOCUMENTS 3,648,906 A * 3/1972 Ross ..... 224/587
4,346,827 A * 8/1982 Bianchi et al. ..... 224/243
4,903,874 A * 2/1990 Shoemaker ..... 2/327
5,120,288 A * 6/1992 Sinaki ..... 128/DIG. 19
5,263,618 A * 11/1993 Talavera ..... 224/148.2
5,358,159 A * 10/1994 Lundie, Jr. ..... 224/245
D370,776 S 6/1996 Frey
D374,980 S 10/1996 Moya et al.
5,586,704 A 12/1996 Alexander et al.
5,624,065 A * 4/1997 Steffe ..... 2/312
5,653,367 A * 8/1997 Abramson ..... 224/197
5,775,558 A 7/1998 Montalbano
5,816,460 A * 10/1998 Cook ..... 224/260
5,967,393 A 10/1999 Clarke
6,375,056 B1 * 4/2002 Henri ..... 224/250
6,390,346 B1 * 5/2002 Thomas ..... 224/236

* cited by examiner

*Primary Examiner*—Stephen P. Garbe

(57) ABSTRACT

A shoulder harness apparatus for carrying personal items on an upper body portion of a user. The shoulder harness apparatus includes a main harness member designed to be worn over the shoulders of a user, and a plurality of detachable holders and sleeves for carrying personal items.

12 Claims, 3 Drawing Sheets

SHOULDER HARNESS APPARATUS

BACKGROUND OF THE INVENTION

1. Field of the Invention

The present invention relates to shoulder harness apparatus' and more particularly pertains to a new shoulder harness apparatus for carrying personal items on an upper body portion of a user.

2. Description of the Prior Art

The use of shoulder harness apparatus' is known in the prior art. More specifically, shoulder harness apparatus' heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,586,704; U.S. Pat. No. 5,775,558; U.S. Pat. No. 5,967,393; U.S. Pat. No. 5,358,159; U.S. Pat. No. Des. 370,776; and U.S. Pat. No. Des. 374,480.

While these devices fulfill their respective, particular objectives and requirements, the aforementioned patents do not disclose a new shoulder harness apparatus. The inventive device includes a main harness member designed to be worn over the shoulders of a user, and a plurality of detachable holders and sleeves for carrying personal items.

In these respects, the shoulder harness apparatus according to the present invention substantially departs from the conventional concepts and designs of the prior art, and in so doing provides an apparatus primarily developed for the purpose of carrying personal items on an upper body portion of a user.

SUMMARY OF THE INVENTION

In view of the foregoing disadvantages inherent in the known types of shoulder harness apparatus' now present in the prior art, the present invention provides a new shoulder harness apparatus construction wherein the same can be utilized for carrying personal items on an upper body portion of a user.

The general purpose of the present invention, which will be described subsequently in greater detail, is to provide a new shoulder harness apparatus and method which has many of the advantages of the shoulder harness apparatus' mentioned heretofore and many novel features that result in a new shoulder harness apparatus which is not anticipated, rendered obvious, suggested, or even implied by any of the prior art shoulder harness apparatus', either alone or in any combination thereof.

To attain this, the present invention generally comprises a main harness member designed to be worn over the shoulders of a user, and a plurality of detachable holders and sleeves for carrying personal items.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoulder harness apparatus apparatus and method which has many of the advantages of the shoulder harness apparatus' mentioned heretofore and many novel features that result in a new shoulder harness apparatus which is not anticipated, rendered obvious, suggested, or even implied by any of the prior art shoulder harness apparatus', either alone or in any combination thereof.

It is another object of the present invention to provide a new shoulder harness apparatus which may be easily and efficiently manufactured and marketed.

It is a further object of the present invention to provide a new shoulder harness apparatus which is of a durable and reliable construction.

An even further object of the present invention is to provide a new shoulder harness apparatus which is susceptible of a low cost of manufacture with regard to both materials and labor, and which accordingly is then susceptible of low prices of sale to the consuming public, thereby making such shoulder harness apparatus economically available to the buying public.

Still yet another object of the present invention is to provide a new shoulder harness apparatus which provides in the apparatuses and methods of the prior art some of the advantages thereof, while simultaneously overcoming some of the disadvantages normally associated therewith.

Still another object of the present invention is to provide a new shoulder harness apparatus for carrying personal items on an upper body portion of a user.

Yet another object of the present invention is to provide a new shoulder harness apparatus which includes a main harness member designed to be worn over the shoulders of a user, and a plurality of detachable holders and sleeves for carrying personal items.

Still yet another object of the present invention is to provide a new shoulder harness apparatus that is designed to hold a wide variety of items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
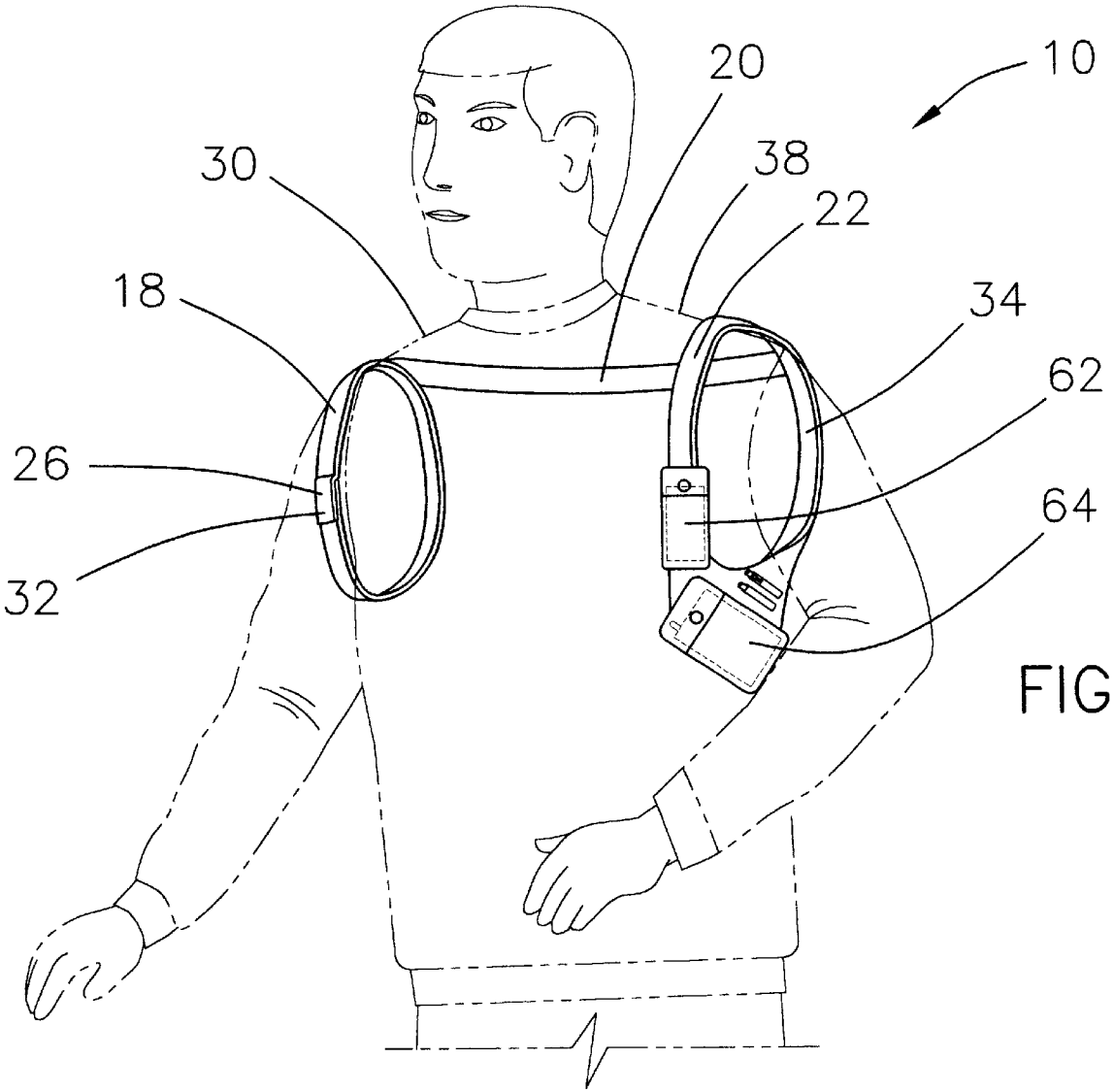
FIG. 1 is a perspective view of a new shoulder harness apparatus according to the present invention.
Figure 2:
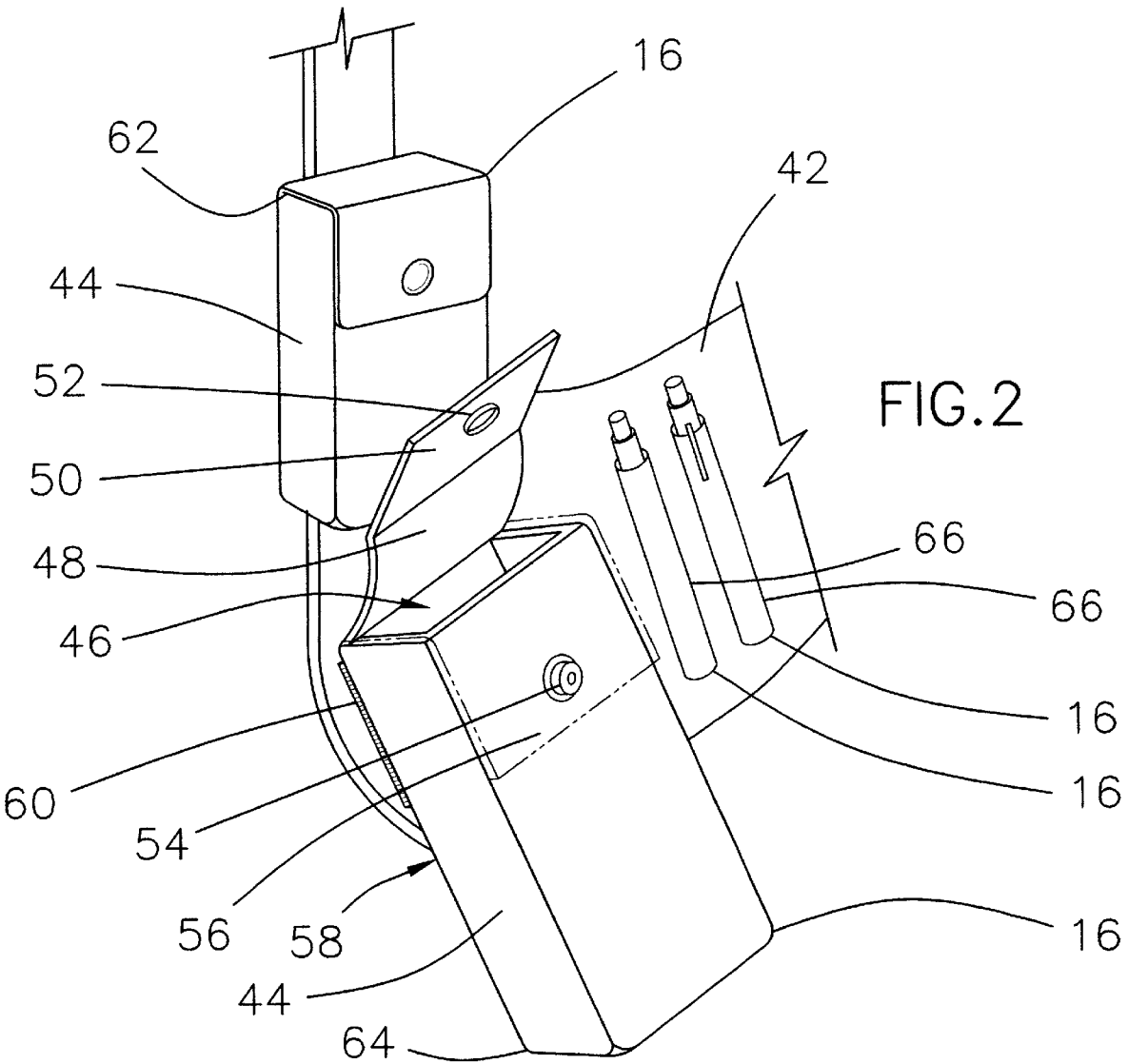
FIG. 2 is a perspective view of the holders of the present invention.
Figure 3:
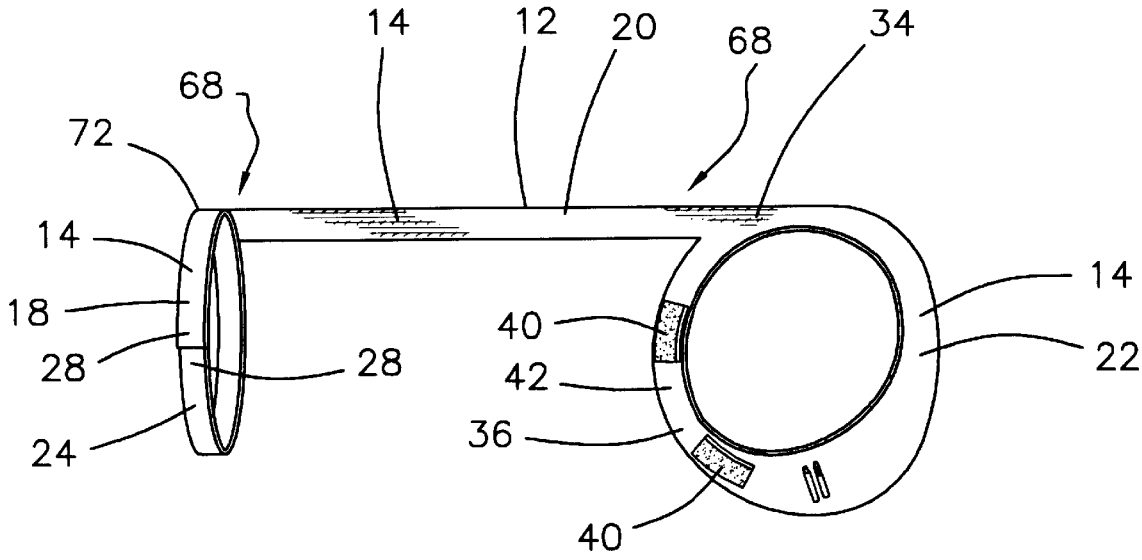
FIG. 3 is a front view of the present invention.

With reference now to the drawings, and in particular to FIGS. 1 through 3 thereof, a new shoulder harness apparatus embodying the principles and concepts of the present invention and generally designated by the reference numeral 10 will be described.

As best illustrated in FIGS. 1 through 3, the shoulder harness apparatus 10 generally comprises a main harness member 12. The main harness member 12 comprises a plurality of strap members 14. The strap members 14 are designed for being worn over shoulders of a user.

The main harness member 12 has a plurality of holders 16. The holders 16 are designed for carrying personal items at or near chest level of the user such that the personal items do not interfere with normal activities and are readily accessible to the user.

The plurality of strap members 14 comprises a shoulder securing strap member 18, a rear connecting strap member 20, and a shoulder device strap member 22. The strap members 14 form the main harness member 12 such that the strap members 14 are designed for being worn over the shoulders of the user.

The shoulder securing strap member 18 has a front portion 24. The front portion 24 has a coupling means 26 for selectively coupling opposing ends 28 of the shoulder securing strap member 18 such that the shoulder securing strap member 18 wraps around a first shoulder portion 30 of the user allowing the user to secure the shoulder securing strap member 18 around the first shoulder portion 30.

The coupling means 26 includes one from a group of coupling means 26. The group of coupling means 26 includes a hook and loop fastening system 32, a button snap system, and a belt buckle-type latching system.

The shoulder device strap member 22 comprises a rear portion 34 and a front panel portion 36. The portions 34, 36 form the shoulder device strap member 22 such that the shoulder device strap member 22 wraps around a second shoulder portion 38 of the user allowing the user to secure the shoulder device strap member 22 around the second shoulder portion 38.

The front panel portion 36 of the shoulder device strap member 22 has a plurality of first portions of a hook and loop fastener 40. The first portions of a hook and loop fastener 40 are positioned on a front surface 42 of the front panel portion 36.

The first portions of a hook and loop fastener 40 are designed for allowing the user to selectively couple the personal items to the front panel portion 36 of the shoulder device strap member 22 for the purpose of carrying the personal items.

A plurality of pouch members 44 has at least one compartment 46. The compartments 46 are designed for holding the personal items.

The pouch members 44 include a flap portion 48. The flap portions 48 of the pouch members 44 are designed for fully enclosing the compartments 46 of the pouch members 44.

A front section 50 of the flap portions 48 includes a female snap member 52. The female snap member 52 is designed for selectively coupling to a male snap member 54. The male snap member 54 is positioned on a forward surface 56 of the pouch members 44 such that the personal items are prevented from falling out of the pouch members 44 when the snap members are coupled.

The pouch members 44 have a rear surface 58. The rear surfaces 58 are fixedly coupled to a second portion of a hook and loop fastener 60. The second portions of a hook and loop fastener 60 are designed for being coupled to the first portions of a hook and loop fastener 40 of the front panel portion 36 of the shoulder device strap member 22, thereby allowing the pouch members 44 to be selectively coupled to the main harness member 12.

A first of the pouch members 44 comprises a pager pouch 62. The pager pouch 62 is designed for holding an electronic pager device.

A second of the pouch members 44 comprises a phone pouch 64. The phone pouch 64 is designed for holding a portable phone device.

The front panel portion 36 of the shoulder device strap member 22 has a plurality of sleeve members 66. The sleeve members 66 are positioned proximate the pouch members 44. The sleeve members 66 are designed for holding writing devices such as a pen or pencil or the like.

Opposite ends 68 of the rear connecting strap member 20 are fixedly coupled to a rear portion 34 of the shoulder device strap member 22 and a rear section 72 of the shoulder securing strap member 18 such that the rear connecting strap member 20 lays across a back of the shoulders of the user, thereby securing the main harness member 12 to the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoulder harness apparatus for carrying personal items on an upper body portion of a user, the shoulder harness apparatus comprising:

a main harness member, said main harness member comprising a plurality of strap members, said strap members being adapted for being worn over the shoulders of the user;

said main harness member having a plurality of holders, said holders being adapted for carrying personal items at or near chest level of the user such that the personal items do not interfere with normal activities and are readily accessible to the user;

said plurality of strap members comprising a shoulder securing strap member, a rear connecting strap member, and a shoulder device strap member, said strap members forming said main harness member such that said strap members being adapted for being worn over the shoulders of the user;

said shoulder securing strap member having a front portion, said front portion having a coupling means for selectively coupling opposing ends of said shoulder securing strap member such that said shoulder securing strap member wraps around a first shoulder portion of the user allowing the user to secure said shoulder securing strap member around the first shoulder portion;

said coupling means including one from a group of coupling means, said group of coupling means including a hook and loop fastening system, a button snap system, and a belt buckle-type latching system;

said shoulder device strap member comprising a back portion and a front panel portion, said portions forming said shoulder device strap member such that said shoulder device strap member wraps around a second shoulder portion of the user allowing the user to secure said shoulder device strap member around the second shoulder portion;

said front panel portion of said shoulder device strap member having a plurality of first portions of a hook and loop fastener, said first portions of a hook and loop fastener being positioned on a front surface of said front panel portion, said first portions of a hook and loop fastener being adapted for allowing the user to selectively couple the personal items to said front panel portion of said shoulder device strap member for the purpose of carrying the personal items.

2. The shoulder harness apparatus as set forth in claim 1, further comprising:

a plurality of pouch members, said pouch members having at least one compartment, said compartments being adapted for holding the personal items; and said pouch members including a flap portion, said flap portions of said pouch members being adapted for fully enclosing said compartments of said pouch members, a front section of said flap portions including a female snap member, said female snap member being adapted for selectively coupling to a male snap member, said male snap member being positioned on a forward surface of said pouch members such that the personal items are prevented from falling out of said pouch members when said snap members being coupled.

3. The shoulder harness apparatus as set forth in claim 2, further comprising:

said pouch members having a rear surface, said rear surfaces being fixedly coupled to a second portion of a hook and loop fastener, said second portions of a hook and loop fastener being adapted for being coupled to said first portion of a hook and loop fastener of said front panel portion of said shoulder device strap member thereby allowing said pouch members to be selectively coupled to said main harness member.

4. The shoulder harness apparatus as set forth in claim 3, further comprising:

a first of said pouch members comprising a pager pouch, said pager pouch being adapted for holding an electronic pager device; and a second of said pouch members comprising a phone pouch, said phone pouch being adapted for holding a portable phone device.

5. The shoulder harness apparatus as set forth in claim 4, further comprising:

said front panel portion of said shoulder device strap member having a plurality of sleeve members, said sleeve members being positioned proximate said pouch members, said sleeve members being adapted for holding writing devices such as a pen or pencil or the like.

6. A shoulder harness apparatus for carrying personal items on an upper body portion of a user, the shoulder harness apparatus comprising:

a main harness member, said main harness member comprising a plurality of strap members, said strap members being adapted for being worn over the shoulders of the user;

said main harness member having a plurality of holders, said holders being adapted for carrying personal items at or near chest level of the user such that the personal items do not interfere with normal activities and are readily accessible to the user;

said plurality of strap members comprising a shoulder securing strap member, a rear connecting strap member, and a shoulder device strap member, said strap members forming said main harness member such that said strap members being adapted for being worn over the shoulders of the user;

said shoulder securing strap member having a front portion, said front portion having a coupling means for selectively coupling opposing ends of said shoulder securing strap member such that said shoulder securing strap member wraps around a first shoulder portion of the user allowing the user to secure said shoulder securing strap member around the first shoulder portion;

said coupling means including one from a group of coupling means, said group of coupling means including a hook and loop fastening system, a button snap system, and a belt buckle-type latching system;

said shoulder device strap member comprising a back portion and a front panel portion, said portions forming said shoulder device strap member such that said shoulder device strap member wraps around a second shoulder portion of the user allowing the user to secure said shoulder device strap member around the second shoulder portion;

said front panel portion of said shoulder device strap member having a plurality of first portions of a hook and loop fastener, said first portions of a hook and loop fastener being positioned on a front surface of said front panel portion, said first portions of a hook and loop fastener being adapted for allowing the user to selectively couple the personal items to said front panel portion of said shoulder device strap member for the purpose of carrying the personal items;

a plurality of pouch members, said pouch members having at least one compartment, said compartments being adapted for holding the personal items;

said pouch members including a flap portion, said flap portions of said pouch members being adapted for fully enclosing said compartments of said pouch members, a front section of said flap portions including a female snap member, said female snap member being adapted for selectively coupling to a male snap member, said male snap member being positioned on a forward surface of said pouch members such that the personal items are prevented from falling out of said pouch members when said snap members being coupled;

said pouch members having a rear surface, said rear surfaces being fixedly coupled to a second portion of a hook and loop fastener, said second portions of a hook and loop fastener being adapted for being coupled to said first portion of a hook and loop fastener of said front panel portion of said shoulder device strap member thereby allowing said pouch members to be selectively coupled to said main harness member;

a first of said pouch members comprising a pager pouch, said pager pouch being adapted for holding an electronic pager device;

a second of said pouch members comprising a phone pouch, said phone pouch being adapted for holding a portable phone device;

said front panel portion of said shoulder device strap member having a plurality of sleeve members, said sleeve members being positioned proximate said pouch members, said sleeve members being adapted for holding writing devices such as a pen or pencil or the like;

distal ends of said rear connecting strap member being fixedly coupled to a back portion of said shoulder device strap member and a rear section of said shoulder securing strap member such that said rear connecting strap member lays across a back of the shoulders of the user thereby securing said main harness member to the user.

7. A shoulder harness apparatus for carrying personal items on an upper body portion of a user, the shoulder harness apparatus comprising:

a main harness member, said main harness member comprising a plurality of strap members, said strap members being adapted for being worn over the shoulders of the user;

said main harness member having a plurality of holders, said holders being adapted for carrying personal items at or near chest level of the user such that the personal items do not interfere with normal activities and are readily accessible to the user;

said plurality of strap members comprising a shoulder securing strap member, a rear connecting strap member, and a shoulder device strap member, said strap members forming said main harness member such that said strap members being adapted for being worn over the shoulders of the user;

said shoulder securing strap member having a front portion, said front portion having a coupling means for selectively coupling opposing ends of said shoulder securing strap member such that said shoulder securing strap member wraps around a first shoulder portion of the user allowing the user to secure said shoulder securing strap member around the first shoulder portion;

said shoulder device strap member comprising a back portion and a front panel portion, said portions forming said shoulder device strap member such that said shoulder device strap member wraps around a second shoulder portion of the user allowing the user to secure said shoulder device strap member around the second shoulder portion;

said front panel portion of said shoulder device strap member having a plurality of first portions of a hook and loop fastener, said first portions of a hook and loop fastener being positioned on a front surface of said front panel portion, said first portions of a hook and loop fastener being adapted for allowing the user to selectively couple the personal items to said front panel portion of said shoulder device strap member for the purpose of carrying the personal items.

8. The shoulder harness apparatus as set forth in claim 7, further comprising:

a plurality of pouch members, said pouch members having at least one compartment, said compartments being adapted for holding the personal items; and said pouch members including a flap portion, said flap portions of said pouch members being adapted for fully enclosing said compartments of said pouch members, a front section of said flap portions including a female snap member, said female snap member being adapted for selectively coupling to a male snap member, said male snap member being positioned on a forward surface of said pouch members such that the personal items are prevented from falling out of said pouch members when said snap members being coupled.

9. The shoulder harness apparatus as set forth in claim 8, further comprising:

said pouch members having a rear surface, said rear surfaces being fixedly coupled to a second portion of a hook and loop fastener, said second portions of a hook and loop fastener being adapted for being coupled to said first portion of a hook and loop fastener of said front panel portion of said shoulder device strap member thereby allowing said pouch members to be selectively coupled to said main harness member.

10. The shoulder harness apparatus as set forth in claim 9, further comprising:

a first of said pouch members comprising a pager pouch, said pager pouch being adapted for holding an electronic pager device; and a second of said pouch members comprising a phone pouch, said phone pouch being adapted for holding a portable phone device.

11. The shoulder harness apparatus as set forth in claim 10, further comprising:

said front panel portion of said shoulder device strap member having a plurality of sleeve members, said sleeve members being positioned proximate said pouch members, said sleeve members being adapted for holding writing devices such as a pen or pencil or the like.

12. The shoulder harness apparatus as set forth in claim 11, further comprising:

distal ends of said rear connecting strap member being fixedly coupled to a back portion of said shoulder device strap member and a rear section of said shoulder securing strap member such that said rear connecting strap member lays across a back of the shoulders of the user thereby securing said main harness member to the user.

* * * * *